US009362632B2

(12) United States Patent
Sunaga et al.

(10) Patent No.: US 9,362,632 B2
(45) Date of Patent: Jun. 7, 2016

(54) TERMINATION STRUCTURE, TERMINATION METHOD AND TERMINATION TERMINAL FOR HIGH-SPEED TRANSMISSION LINE

(71) Applicant: Hitachi Metals, Ltd., Tokyo (JP)

(72) Inventors: Yoshinori Sunaga, Hitachinaka (JP); Hideki Nonen, Mito (JP); Takahiro Sugiyama, Hitachi (JP); Osamu Seya, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 1 day.

(21) Appl. No.: 14/243,809

(22) Filed: Apr. 2, 2014

(65) Prior Publication Data

US 2014/0338951 A1 Nov. 20, 2014

(30) Foreign Application Priority Data

May 15, 2013 (JP) ..... 2013-103137

(51) Int. Cl.
*H01R 24/38* (2011.01)
*H01R 9/03* (2006.01)

(52) U.S. Cl.
CPC ..... *H01R 9/032* (2013.01)

(58) Field of Classification Search
CPC ..... H01R 24/38; H01R 43/00; H01R 9/24; H01R 12/61; H01R 12/7005; H01R 13/187; H01B 7/00
USPC ..... 174/78, 113 R
See application file for complete search history.

(56) References Cited

U.S. PATENT DOCUMENTS

| | | | | |
|---|---|---|---|---|
| 2,948,940 | A * | 8/1960 | Degener | 403/188 |
| 7,906,730 | B2 | 3/2011 | Atkinson et al. | |
| 2011/0075388 | A1* | 3/2011 | Zadesky | H01R 4/024 361/767 |
| 2012/0285723 | A1* | 11/2012 | Gundel | H01B 7/0861 174/113 R |
| 2013/0062116 | A1* | 3/2013 | Huang | H01B 7/083 174/74 R |
| 2014/0199885 | A1* | 7/2014 | Vinther et al. | 439/578 |

* cited by examiner

*Primary Examiner* — Hoa C Nguyen
*Assistant Examiner* — Stanley Tso
(74) *Attorney, Agent, or Firm* — McGinn IP Law Group, PLLC.

(57) ABSTRACT

A termination structure for high-speed transmission line includes a high-speed transmission line including a signal line configured to transmit a signal, an insulation which covers the signal line and an external conductor disposed at an outer periphery of the insulation, and a termination terminal disposed at a terminal of the high-speed transmission line. The termination terminal includes a holder disposed sandwiching the external conductor exposed at the terminal of the high-speed transmission line from both sides. The holder includes a holding part to hold the high-speed transmission line and is electrically connected to the external conductor. The holding part is formed so as to have a shape along an outer shape of the external conductor.

20 Claims, 3 Drawing Sheets

Prior Art

TERMINATION STRUCTURE, TERMINATION METHOD AND TERMINATION TERMINAL FOR HIGH-SPEED TRANSMISSION LINE

The present application is based on Japanese patent application No. 2013-103137 filed on May 15, 2013, the entire contents of which are incorporated herein by reference.

BACKGROUND OF THE INVENTION

1. Field of the Invention

This invention relates to a termination structure, a termination method and a termination terminal for a high-speed transmission line.

2. Description of the Related Art

According to miniaturization of a semiconductor process in recent years, in a semiconductor chip (an IC chip) used for a high performance server and a high-speed network device, the performance thereof has been enhanced with great impetus. In association with this, the speeding up of signals input into or output from the semiconductor chip has been progressed, thus in next generation semiconductor chip, it is considered that use of approximately 25 Gbit/s per channel becomes common.

As a high-speed transmission line used for digital signal transmission between devices such as communication devices in a distance of approximately 1 to 10 m, a two core coaxial cable having two signal lines for transmitting differential signals is commonly used, but it is needed to use one that has particularly excellent characteristics, in case of ultra-high speed digital signal transmission of approximately 25 Gbit/s as described above.

As a two core coaxial cable used for the high-speed transmission line, one is generally known, the one being obtained by collectively or separately covering two signal lines with an insulation, and winding a metal tape on the periphery of the insulation so as to form an external conductor, the metal tape including a resin tape and a metal layer formed on one surface of the resin tape and comprised of copper or the like.

Conventionally, as the above-mentioned high-speed transmission line, one having a drain wire for grounding of the external conductor is known. In the high-speed transmission line having the drain wire, the drain wire is electrically connected to a ground line such as a substrate by soldering or the like, thereby the external conductor can be easily grounded. However, in the two core coaxial cable having a drain wire, there is a problem that the drain wire has an impact on the electric field distribution of the inside of the cable so as to easily cause characteristics deterioration, thus it cannot be said that the two core coaxial cable having a drain wire is appropriate for the above-mentioned ultra-high speed digital signal transmission.

Consequently, it is preferred to use a high-speed transmission line without the drain wire, however, in this case, the problem is how to connect the external conductor to a ground line such as a substrate.

As shown in FIG. 5, for a conventional high-speed transmission line 51 without the drain wire, a method is used that is configured to directly connect an external conductor 52 exposed at a terminal of the high-speed transmission line 51 to a ground pattern 55 of a substrate 54 by using a solder 57 that is rather much, and to bend signal lines 53 to a side of the substrate 54 so as to connect the signal lines 53 to signal patterns 56.

Meanwhile, prior arts relating to the invention may include U.S. Pat. No. 7,906,730.

SUMMARY OF THE INVENTION

The connection structure as shown in FIG. 5 has a problem that it is difficult to uniformly solder the external conductor 52, in addition, the external conductor 52 is composed of a metal tape that has a low mechanical strength, thus stress easily concentrates on the external conductor 52 located at an interface between a part being wetted and a part being not wetted with the solder 57 and there is a risk that cracks occur in the external conductor 52.

Further, in the conventional method, it is needed to carry out the soldering while holding down the high-speed transmission line by the hand, so as to be poor in workability, and further, there is a risk that the high-speed transmission line is deformed due to heat at the time of the soldering so as to deteriorate the characteristics.

It is an object of the invention to provide a termination structure, a termination method and a termination terminal for high-speed transmission line that can prevent the characteristics deterioration caused by the breakage and deformation of an external conductor and enhance the workability of connection work to a substrate or the like.

(1) According to one embodiment of the invention, a termination structure for high-speed transmission line comprises:

a high-speed transmission line comprising a signal line configured to transmit a signal, an insulation which covers the signal line and an external conductor disposed at an outer periphery of the insulation; and a termination terminal disposed at a terminal of the high-speed transmission line, wherein the termination terminal comprises a holder disposed sandwiching the external conductor exposed at the terminal of the high-speed transmission line from both sides, wherein the holder comprises a holding part to hold the high-speed transmission line and is electrically connected to the external conductor, and wherein the holding part is formed so as to have a shape along an outer shape of the external conductor.

In the above embodiment (1) of the invention, the following modifications and changes can be made.

(i) A solder or a conductive adhesive is interposed between the external conductor and the holder.

(ii) The high-speed transmission line is configured such that the two signal lines arranged in parallel are collectively covered with the insulation and the external conductor is disposed in the outer periphery of the insulation.

(iii) The external conductor is configured such that a metal tape comprising a resin tape and a metal layer formed on one surface of the resin tape is wound around the outer surface of the insulation.

(iv) The holder further comprises a plurality of the holding parts so as to hold a plurality of the high-speed transmission lines.

(v) The holder further comprises two divided holders that sandwich the external conductor from the both sides, and the two divided holders are swaged so as to be fixed with each other after sandwiching the external conductor.

(vi) An inflow hole is formed in the holder, the inflow hole being configured to pour a solder or a conductive adhesive between the holder and the external conductor.

(vii) A rib is formed in the holding part of the holder, the rib being configured to regulate a flow of the solder or the conductive adhesive poured, when the solder or the conductive adhesive is poured between the holder and the external conductor.

(viii) A reinforcing adhesive is filled between the holder and the external conductor in a base end part of the holder.

(ix) The holder further comprises a ground terminal configured to be extended in the extension direction of the signal line.

(2) According to another embodiment of the invention, provided is a termination method for high-speed transmission line by which a termination terminal is disposed at a terminal of a high-speed transmission line, the high-speed transmission line comprising a signal line configured to transmit a signal, an insulation which covers the signal line and an external conductor disposed at an outer periphery of the insulation, wherein the termination method comprises disposing a holder as a termination terminal so as to sandwich the external conductor exposed at the terminal of the high-speed transmission line from both sides, wherein the holder comprises a holding part to hold the high-speed transmission line and is electrically connected to the external conductor, and wherein the holding part is formed so as to have a shape along an outer shape of the external conductor.

(3) According to another embodiment of the invention, provided is a termination terminal for high-speed transmission line which is disposed at a terminal of a high-speed transmission line, the high-speed transmission line comprising a signal line configured to transmit a signal, an insulation which covers the signal line and an external conductor disposed at an outer periphery of the insulation, wherein the termination terminal comprises a holder disposed sandwiching the external conductor exposed at the terminal of the high-speed transmission line from both sides, wherein the holder comprises a holding part to hold the high-speed transmission line and is electrically connected to the external conductor, and wherein the holding part is formed so as to have a shape along an outer shape of the external conductor.

Effects of the Invention

According to one embodiment of the invention, a termination structure, a termination method and a termination terminal for high-speed transmission line can be provided that can prevent the characteristics deterioration caused by the breakage and deformation of an external conductor and enhance the workability of connection work to a substrate or the like.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
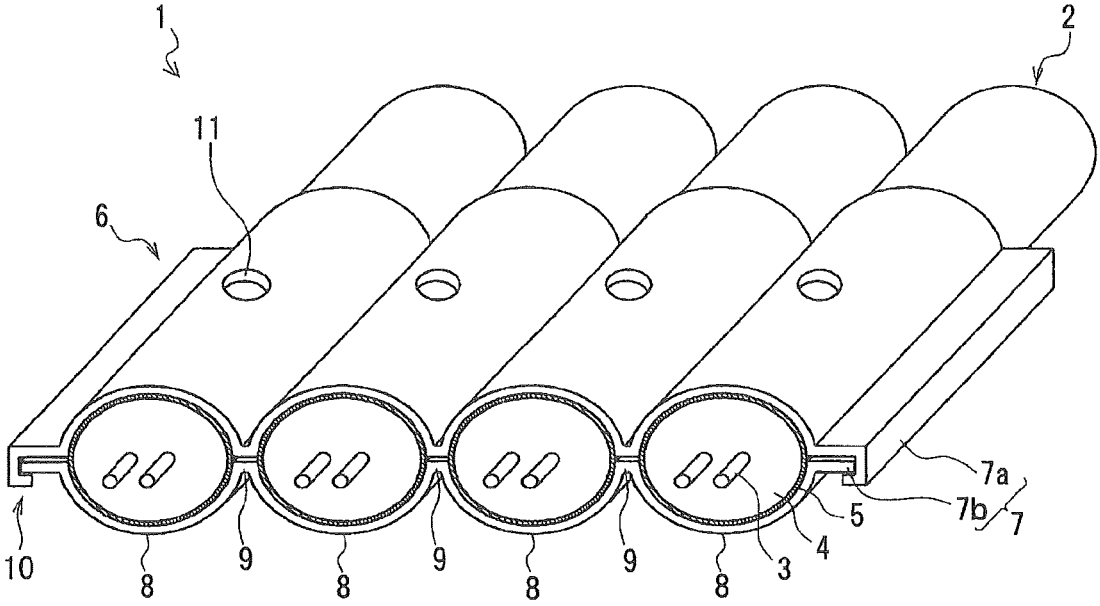
FIG. 1 is a perspective view schematically showing a termination structure for high-speed transmission line according to one embodiment of the invention.

Hereinafter, the preferred embodiment according to the invention will be explained below referring to the drawings.

FIG. 1 is a perspective view schematically showing a termination structure for high-speed transmission line according to the embodiment of the invention.

As shown in FIG. 1, the termination structure 1 for high-speed transmission line is configured such that the termination terminal 6 is disposed in the terminal of the high-speed transmission line 2.

The high-speed transmission line 2 includes a signal line (center conductor) 3 configured to transmit a signal, an insulation 4 which covers the signal line 3 and an external conductor 5 disposed in the outer periphery of the insulation 4.

In the embodiment, a case that a two core coaxial cable is used as the high-speed transmission line 2 will be explained, the two core coaxial cable being configured such that the two signal lines 3 arranged in parallel are collectively covered with the insulation 4 and the external conductor 5 is disposed in the outer periphery of the insulation 4. However, a configuration of the high-speed transmission line 2 is not limited to this, a two core coaxial cable configured such that two signal lines 3 are separately covered with the insulation 4 can be also used, and a single core coaxial cable configured to have a single signal line 3 can be also used.

The external conductor 5 is configured such that a metal tape comprising a resin tape and a metal layer formed on one surface of the resin tape is wound around the outer surface of the insulation 4. In the embodiment, as the metal tape used for the external conductor 5, a copper tape (a film with a copper foil) is used, the copper tape being configured such that copper is deposited on a resin tape comprised of polyethylene terephthalate (PET). The external conductor 5 can be configured such that a metal tape is laterally wound, and also can be configured such that a metal tape is longitudinally wound.

The termination terminal 6 has a holder 7 disposed in such a way as to sandwich the external conductor 5 exposed in the terminal part of the high-speed transmission line 2 from the both sides, so as to hold the high-speed transmission line 2, and simultaneously be electrically connected to the external conductor 5. The holder 7 is formed in a two-divided configuration, and includes two divided holders 7*a*, 7*b* that sandwich the external conductor 5 from the both sides in the perpendicular direction (referred to as "short axis direction") to the arrangement direction of the signal line 3.

The holder 7 is configured to be connected to a ground line of a connection target object such as a substrate. Further, the termination terminal 6 may include, for example, a member (not shown) configured to fix the holder 7 to the substrate or the like.

The holder 7 is configured such that the holding part 8 configured to hold the high-speed transmission line 2 is formed in an arc shape along the outer shape of the external conductor 5, and when the high-speed transmission line 2 is held by the holding part 8, the inner peripheral surface of the holding part 8 is in close contact with the surface of the external conductor 5. In the embodiment, the outer shape of the external conductor 5 is formed elliptical in a cross sectional view, thus the holding part 8 is formed elliptical corresponding to the outer shape of the external conductor 5.

In addition, in the embodiment, the holder 7 includes a plurality of holding parts 8 so as to hold a plurality of high-speed transmission lines 2. Here, a case that the holder 7 includes four holding parts 8 for the purpose of holding four high-speed transmission lines 2 will be explained, but the number of the holding part 8 (namely, the number of the high-speed transmission line 2 to be held) is not particularly limited, the number of 1 to 3 or not less than 5 can be also adopted.

In the embodiment, the holder 7 is configured such that the division position thereof is set to the center part in the short axis direction of the high-speed transmission line 2. However, not limited to this, as the division position of the holder 7, a position deviated from the center part in the short axis direction can be also adopted. For example, in the case that the division position is deviated from the center part in the upper direction in FIG. 1, the high-speed transmission lines 2 are fitted into the holding parts 8 of the lower divided holder 7*b* so as to be aligned, thus this makes it possible to prevent the high-speed transmission lines 2 from falling off from the holder 7 during work for aligning the high-speed transmission lines 2, and to enhance workability when the high-speed transmission lines 2 are aligned.

The divided holders 7*a*, 7*b* are configured such that the holding parts 8 are connected to each other via connection pieces 9, the holding parts 8 being formed in an approximately semielliptic arc shape and arranged at equal intervals in the arrangement direction (referred to as "long axis direction") of the signal line 3. The divided holders 7*a*, 7*b* are formed by applying a press processing to a metal plate comprised of copper or a copper alloy.

In addition, in the embodiment, two divided holders 7*a*, 7*b* are configured to be swaged so as to be fixed with each other after sandwiching the external conductor 5. In both end parts of the divided holders 7*a*, 7*b* in the long axis direction, a swaged part 10 configured to swage the divided holders 7*a*, 7*b* so as to fix to each other is respectively formed.

Here, a configuration is adopted, that both end parts of the one divided holder 7*b* in the long axis direction are formed so as to be projected in the long axis direction and simultaneously both end parts of the another divided holder 7*a* in the long axis direction are formed so as to have a hook-like shape that covers the projection part, and in the condition of the both end parts of the divided holders 7*a*, 7*b* being locked into each other, the both end parts of the divided holders 7*a*, 7*b* are swaged so as to be fixed to each other by using a jig (not shown) or the like. Further, a shape of the swaged part 10 is not limited to this.

In addition, in the embodiment, when the external conductors 5 are sandwiched between the two divided holders 7*a*, 7*b*, the connection pieces 9 of both the divided holders 7*a*, 7*b*, the connection pieces 9 facing each other, are configured not to be brought into contact with each other and to mutually be separated. The above-mentioned configuration makes it possible to transmit a holding force due to swaging in the swaged part 10 to the holding parts 8, so as to firmly hold the high-speed transmission lines 2 in the holding parts 8.

Figure 2:
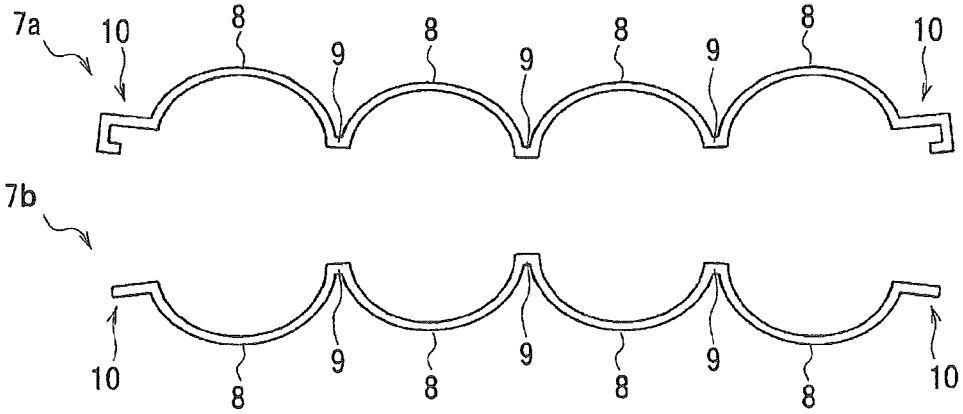
FIG. 2 is a side view schematically showing a holder used for the termination structure for high-speed transmission line shown in FIG. 1 when viewed from a tip side of the holder.

In the embodiment, the swaging is carried out in both end parts in the long axis direction, thus floating is generated in the center part in the long axis direction, so that it may not be possible to firmly hold the high-speed transmission lines 2. Therefore, as shown in FIG. 2, the embodiment is configured such that both the divided holders 7*a*, 7*b* are preliminarily formed so as to be warped in such a manner that the center parts thereof in the long axis direction are curved convexly toward the side of the high-speed transmission lines 2, thereby when the swaging is carried out in both end parts in the long axis direction, the generation of floating in the center part in the long axis direction is prevented. Further, here, both the divided holders 7*a*, 7*b* are formed to be warped, but not limited to this, only any one of the divided holders 7*a*, 7*b* may be formed to be warped.

In addition, the termination structure 1 for high-speed transmission line is configured such that a solder is interposed between the external conductor 5 and the holder 7. Further, a thermosetting or thermoplastic conductive adhesive can be also interposed between the external conductor 5 and the holder 7. An inflow hole 11 is formed in the holder 7, the inflow hole 11 being configured to pour a solder or a conductive adhesive between the holder 7 and the external conductor 5. Further, the inflow hole 11 is formed also in the divided holder 7*b* shown at the lower part of FIG. 1 similarly to the divided holder 7*a*, though it is not shown in FIG. 1.

Further, the inflow hole 11 can be omitted, for example, without forming the inflow hole 11, a solder sheet is sandwiched between the external conductor 5 and the holder 7 and heat processing is carried out by ironing or the like, thereby the external conductor 5 and the holder 7 can be also connected to each other by soldering.

Next, the termination method for high-speed transmission line according to the embodiment will be explained.

In the termination method for high-speed transmission line, first the terminal part of the high-speed transmission line 2 configured such that the external conductor 5 is exposed is disposed in each holding part 8 of the one divided holder 7*b*, so that the high-speed transmission lines 2 are arranged in proper alignment. After that, the another divided holder 7*a* is arranged in such a way as to sandwich the external conductor 5 exposed in the terminal part of the high-speed transmission line 2, both the end parts of the divided holders 7*a*, 7*b* are locked into each other, and the swaged parts 10 of the divided holders 7*a*, 7*b* are swaged so as to be fixed to each other. Thereby, the holder 7 and the high-speed transmission line 2 are fixed at once before soldering.

After that, a solder is poured from the inflow hole 11 of the holder 7 so as to fix the external conductor 5 and the holder 7 by soldering. Thereby, the termination structure 1 for high-speed transmission line according to the invention can be obtained, the termination structure 1 for high-speed transmission line being configured such that the holder 7 is disposed in such a way as to sandwich the external conductor 5 exposed in the terminal part of the high-speed transmission line 2 from the both sides, so as to hold the high-speed transmission line 2 by the holding part 8 of the holder 7 and simultaneously be electrically connected to the external conductor 5, and the termination terminal 6 is disposed in a terminal of the high-speed transmission line 2.

As explained above, in the termination structure 1 for high-speed transmission line according to the embodiment, the termination terminal 6 has the holder 7 disposed in such a way as to sandwich the external conductor 5 exposed in the terminal part of the high-speed transmission line 2 from the both sides so as to hold the high-speed transmission line 2 and simultaneously be electrically connected to the external conductor 5, and the holder 7 is configured such that the holding part 8 thereof configured to hold the high-speed transmission line 2 is formed in a shape along the outer shape of the external conductor 5.

This configuration makes it possible to closely bring the holder 7 that is a metal component having a high strength into contact with the external conductor 5 so as to prevent a large stress from being applied to the external conductor 5 and prevent the external conductor 5 from being broken due to the fact that a large stress is applied to the external conductor 5.

In addition, the holder 7 is closely brought into contact with the high-speed transmission line 2 so that the high-speed transmission line 2 can be firmly held by the holder 7. Furthermore, the holding part 8 is formed in a shape along the outer shape of the external conductor 5, thus the high-speed transmission line 2 can be prevented from being deformed while the high-speed transmission line 2 is firmly held by the holder 7, thereby the high-speed transmission line 2 can be prevented from being deteriorated in characteristics due to deformation of the high-speed transmission line 2.

In addition, in the termination structure 1 for high-speed transmission line, the holder 7 is disposed in the high-speed transmission line 2, and the holder 7 is configured to be connected to a ground line of a connection target object such as a substrate, thus it is not needed to carry out a soldering operation while pressing the high-speed transmission line 2 as the conventional method, so that workability of connection work to the substrate or the like can be drastically enhanced, in particular, in the case of connecting a plurality of the high-speed transmission lines 2.

Furthermore, the holder 7 is electrically connected to the ground line such as the substrate, thus it is not needed to directly solder the external conductor 5 as the conventional method, so that the high-speed transmission line 2 can be prevented from being deformed due to heat at the time of soldering and can be prevented from being deteriorated in characteristics due to deformation of the high-speed transmission line 2.

Namely, according to the invention, even in the high-speed transmission line 2 not having a drain wire, it becomes possible to terminate the high-speed transmission line 2 with high reliability and good workability by a method excellent in high frequency characteristics.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

Figure 3A:
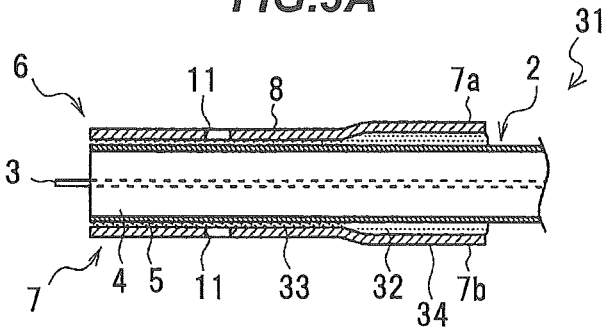
FIGS. 3A, 3B are longitudinal cross-sectional views schematically showing a termination structure for high-speed transmission line according to one modification of the invention.

For example, a termination structure can be also adopted, the termination structure being configured such that a reinforcing adhesive 32 is filled between the external conductor 5 and the holder 7 in the base end part of the holder 7 (an insertion side end part of the high-speed transmission line 2) as a termination structure 31 for high-speed transmission line shown in FIG. 3A. Here, a configuration is adopted, that the inner diameter of the base end part of the holder 7 is expanded so as to form a diameter expansion part 34 and the reinforcing adhesive 32 is filled between the inner wall of the diameter expansion part 34 and the external conductor 5.

In the case of interposing a solder 33 between the external conductor 5 and the holder 7, it is considered that stress concentrates on a part of the external conductor 5 being extended from the base end part of the holder 7 (namely a boundary between a part embodiment wetted by the solder 33 and a part not wetted by the solder 33).

Then, the termination structure 31 for high-speed transmission line is configured such that the reinforcing adhesive 32 that is relatively soft is filled between the external conductor 5 and the holder 7 in the base end part of the holder 7 so as to be solidified, thereby stress concentration on the part of the external conductor 5 being extended from the base end part of the holder 7 is alleviated so that the external conductor 5 can be prevented from being damaged.

Figure 3B:
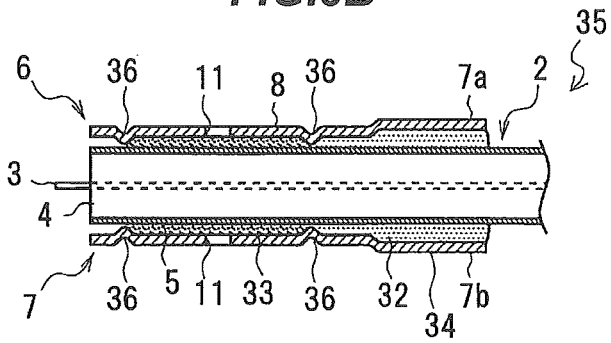

In addition, a termination structure can be also adopted, the termination structure being configured such that a rib 36 configured to regulate the flow of the solder 33 poured when the solder 33 is poured between the external conductor 5 and the holder 7 is formed in the holding part 8 of the holder 7 as a termination structure 35 for high-speed transmission line shown in FIG. 3B.

The termination structure for high-speed transmission line 35 shown in FIG. 3B is configured such that two ribs 36 having an elliptical ring shape are formed at a predetermined interval in the longitudinal direction of the high-speed transmission line 2 and the solder 33 is poured between the two ribs 36, and furthermore in a region located closer to the base end part than the rib 36 of the base end part side, the reinforcing adhesive 32 is filled between the external conductor 5 and the holder 7.

The rib is formed, thereby it becomes possible to prevent the solder excessively poured from protruding therefrom, and to carry out a uniform soldering.

Figure 4:
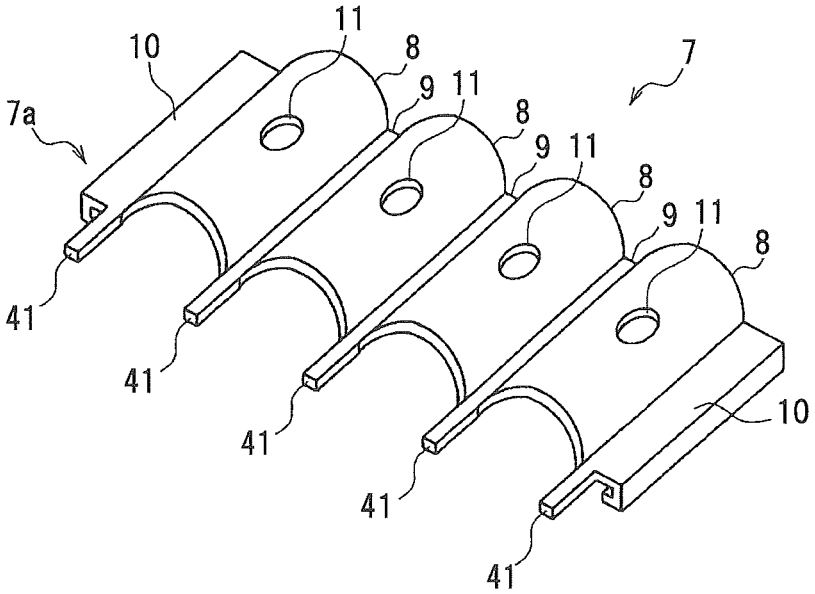
FIG. 4 is a perspective view schematically showing a holder according to one modification.
Figure 5:
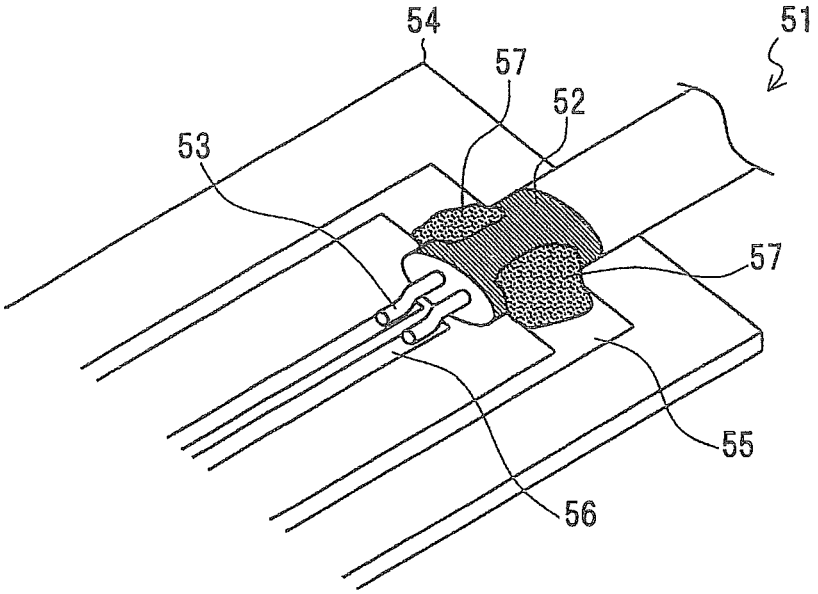
FIG. 5 is a perspective view schematically showing a conventional structure when a high-speed transmission line is connected to a substrate.

Furthermore, as shown in FIG. 4, the holder 7 can be configured such that a ground terminal 41 extended in the extension direction of the signal line 3 (in the longitudinal direction of the high-speed transmission line 2) is formed. The holder 7 shown in FIG. 4 is configured such that the connection piece 9 in the divided holder 7*a* and the swaged part 10 are extended in the tip direction, thereby the ground terminal 41 is formed between the respective high-speed transmission lines 2 and at both side of the arranging direction of the high-speed transmission line 2.

The ground terminal 41 is formed in the holder 7, thereby the ground terminal 41 is, for example, soldered to a ground line of a connection target object such as a substrate, so that it becomes possible to easily connect the holder 7 to the ground line of the substrate or the like. In addition, the ground terminal 41 is formed between the respective high-speed transmission lines 2 and at both side of the arranging direction of the high-speed transmission line 2, thereby it becomes possible to prevent crosstalk between the respective high-speed transmission lines 2.

What is claimed is:

1. A termination structure for high-speed transmission line, the termination structure comprising:

high-speed transmission lines, each of which comprises a signal line configured to transmit a signal, an insulation which covers the signal line, and an external conductor disposed at an outer periphery of the insulation; and a termination terminal disposed at terminals of the high-speed transmission lines, wherein the termination terminal comprises two divided holders formed to be warped in such a manner that a center part in a long axis direction thereof is curved convexly toward a side of the high-speed transmission lines and disposed sandwiching the external conductors exposed at the terminals of the high-speed transmission lines from both sides, wherein the two divided holders comprise holding parts configured to hold the high-speed transmission lines and is electrically connected to the external conductors, wherein the holding parts are formed so as to have a shape along an outer shape of the external conductors, wherein, when disengaged, the two divided holders are configured such that both ends are naturally spaced apart from each other by a repulsive force in the two divided holders, and, when engaged, the both ends come close to each other and swaged to fix the external conductors, and wherein the two divided holders are configured such that the both ends are energized to be separated from each other by elasticity when engaged with each other.

2. The termination structure for high-speed transmission line according to claim 1, wherein a solder or a conductive adhesive is interposed between the external conductors and the two divided holders.

3. The termination structure for high-speed transmission line according to claim 1, wherein the high-speed transmission line is configured such that two signal lines comprising the signal line arranged in parallel are collectively covered with the insulation and the external conductors are disposed in the outer periphery of the insulation.

4. The termination structure for high-speed transmission line according to claim 3, wherein an outer shape of the external conductors is formed elliptical in a cross sectional view.

5. The termination structure for high-speed transmission line according to claim 1, wherein the external conductors are configured such that a metal tape comprising a resin tape and a metal layer formed on one surface of the resin tape is wound around an outer surface of the insulation.

6. The termination structure for high-speed transmission line according to claim 1, wherein an inflow hole is formed in the two divided holders, the inflow hole being configured to pour a solder or a conductive adhesive between the two divided holders and the external conductors.

7. The termination structure for high-speed transmission line according to claim 1, wherein a rib is formed in the holding parts of the two divided holders, the rib being configured to regulate a flow of a solder or a conductive adhesive poured, when the solder or the conductive adhesive is poured between the two divided holders and the external conductors.

8. The termination structure for high-speed transmission line according to claim 1, wherein a reinforcing adhesive is filled between the two divided holders and the external conductors in a base end part of the two divided holders.

9. The termination structure for high-speed transmission line according to claim 1, wherein the two divided holders further comprise a ground terminal configured to be extended in an extension direction of the signal line.

10. The termination structure for high-speed transmission line according to claim 1, wherein, in each of the two divided holders, the holding parts are connected to each other through connection pieces such that the connection pieces of one of the two divided holders face the connection pieces of another one of the two divided holders.

11. The termination structure for high-speed transmission line according to claim 10, wherein the two divided holders are configured such that, when the external conductors are sandwiched between the two divided holders, the connection pieces of said one of the two divided holders and the connection pieces of said another one of the two divided holders are configured not to be brought into contact with each other.

12. The termination structure for high-speed transmission line according to claim 1, wherein a tip portion of each of the two divided holders comprises a swaged part such that the swaged part of one of the two divided holders is configured to engage with the swaged part of another one of the two divided holders.

13. The termination structure for high-speed transmission line according to claim 1, wherein the two divided holders comprise copper or a copper alloy and are curved such that the two divided holders are configured such that the both ends are energized to be separated from each other by the elasticity in the two divided holders when engaged with each other.

14. The termination structure for high-speed transmission line according to claim 1, wherein the center part of each of the two divided holders is curved convexly toward the side of the high-speed transmission lines.

15. A termination terminal for high-speed transmission line which is disposed at terminals of a high-speed transmission lines, each of the high-speed transmission lines comprising a signal line configured to transmit a signal, an insulation which covers the signal line and an external conductor disposed at an outer periphery of the insulation, wherein the termination terminal comprises two divided holders formed to be warped in such a manner that a center part in a long axis direction thereof is curved convexly toward a side of the high-speed transmission lines and disposed sandwiching the external conductors exposed at the terminals of the high-speed transmission lines from both sides, wherein the two divided holders comprise holding parts configured to hold the high-speed transmission lines and is electrically connected to the external conductors, wherein the holding parts are formed so as to have a shape along an outer shape of the external conductors, wherein, when disengaged, the two divided holders are configured such that both ends are naturally spaced apart from each other by a repulsive force in the two divided holders, and, when engaged, the both ends come close to each other and swaged to fix the external conductors, and wherein the two divided holders are configured such that the both ends are energized to be separated from each other by elasticity when engaged with each other.

16. The termination terminal for high-speed transmission line according to claim 15, wherein an inflow hole is formed in the two divided holders, the inflow hole being configured to pour a solder or a conductive adhesive between the two divided holders and the external conductors.

17. The termination terminal for high-speed transmission line according to claim 15, wherein a rib is formed in the holding parts of the two divided holders, the rib being configured to regulate a flow of a solder or a conductive adhesive poured, when the solder or the conductive adhesive is poured between the two divided holders and the external conductors.

18. The termination terminal for high-speed transmission line according to claim 15, wherein the two divided holders further comprise a ground terminal configured to be extended in an extension direction of the signal line.

19. The termination structure for high-speed transmission line according to claim 15, wherein the holding parts are formed elliptical.

20. A termination method for high-speed transmission lines by which a termination terminal is disposed at terminals of the high-speed transmission lines, each of the high-speed transmission lines comprising a signal line configured to transmit a signal, an insulation which covers the signal line, and an external conductor disposed at an outer periphery of the insulation, wherein the termination method comprises disposing two divided holders, formed to be warped in such a manner that a center part in a long axis direction thereof is curved convexly toward a side of the high-speed transmission lines, as the termination terminal so as to sandwich the external conductors exposed at the terminals of the high-speed transmission lines from both sides, wherein the two divided holders comprise holding parts configured to hold the high-speed transmission lines and is electrically connected to the external conductors, wherein the holding parts are formed so as to have a shape along an outer shape of the external conductors, wherein, when disengaged, the two divided holders are configured such that both ends are naturally spaced apart from each other by a repulsive force in the two divided holders, and, when engaged, the both ends come close to each other and swaged to fix the external conductors, and wherein the two divided holders are configured such that the both ends are energized to be separated from each other by elasticity when engaged with each other.

* * * * *